US009701034B2

(12) United States Patent
Papadopoulos-Papageorgis et al.

(10) Patent No.: US 9,701,034 B2
(45) Date of Patent: Jul. 11, 2017

(54) SHAVER

(71) Applicant: BIC-VIOLEX SA, Anixi, Attiki (GR)

(72) Inventors: Phaedon Papadopoulos-Papageorgis, Agios Stefanos (GR); Panagiotis Zafiropoulos, Wallingford, CT (US); Dimitrios Efthimiadis, Nea Kypseli (GR)

(73) Assignee: BIC VIOLEX S.A., Anixi (GR)

( * ) Notice: Subject to any disclaimer, the term of this patent is extended or adjusted under 35 U.S.C. 154(b) by 3 days.

(21) Appl. No.: 14/651,782

(22) PCT Filed: Dec. 21, 2012

(86) PCT No.: PCT/EP2012/076808

§ 371 (c)(1),
(2) Date: Jun. 12, 2015

(87) PCT Pub. No.: WO2014/094910

PCT Pub. Date: Jun. 26, 2014

(65) Prior Publication Data

US 2015/0321366 A1 Nov. 12, 2015

(51) Int. Cl.

| | |
|---|---|
| ***B26B 21/22*** | (2006.01) |
| ***B26B 21/52*** | (2006.01) |
| ***B26B 21/14*** | (2006.01) |

(52) U.S. Cl.

CPC ..... *B26B 21/521* (2013.01); *B26B 21/14* (2013.01); *B26B 21/222* (2013.01); *B26B 21/225* (2013.01); *B26B 21/227* (2013.01)

(58) Field of Classification Search

CPC ..... B26B 21/14; B26B 21/521; B26B 21/222; B26B 21/225; B26B 21/227; B26B 21/4012

See application file for complete search history.

(56) References Cited

U.S. PATENT DOCUMENTS

| | | | | |
|---|---|---|---|---|
| 3,938,247 | A * | 2/1976 | Carbonell | B26B 21/225 30/47 |
| 4,213,240 | A * | 7/1980 | Ferraro | B26B 21/521 30/47 |
| 4,347,663 | A * | 9/1982 | Ullmo | B26B 21/225 30/47 |
| 5,029,391 | A * | 7/1991 | Althaus | B26B 21/521 30/533 |
| 5,038,472 | A * | 8/1991 | Iderosa | B26B 21/521 30/51 |

(Continued)

FOREIGN PATENT DOCUMENTS

| | | | |
|---|---|---|---|
| DE | 20 2013 002 343 | U9 * | 7/2013 |
| EP | 1 935 588 | A1 | 6/2008 |

(Continued)

OTHER PUBLICATIONS

International Report of PCT/EP2012/076808: Sep. 5, 2013.

*Primary Examiner* — Hwei C Payer
(74) *Attorney, Agent, or Firm* — Polsinelli PC

(57) ABSTRACT

A shaver that includes a handle with an elongated handgrip portion and a mounting portion, a shaver head attached to the mounting portion, the shaver head having a back structure. A removable cartridge is attached to the shaver head through a slidable button provided on the shaver head.

17 Claims, 6 Drawing Sheets

(56) References Cited

U.S. PATENT DOCUMENTS

| | | | | |
|---|---|---|---|---|
| 5,070,614 | A * | 12/1991 | Hardin | B26B 21/521 30/527 |
| 7,966,731 | B2 * | 6/2011 | Walker | B26B 21/225 30/34.1 |
| 8,438,735 | B2 * | 5/2013 | De Klerk | B26B 21/446 30/41 |
| 8,484,852 | B2 * | 7/2013 | King | A45D 27/225 30/34.2 |
| 2008/0155831 | A1 * | 7/2008 | Royle | B26B 21/222 30/34.1 |
| 2011/0016724 | A1 | 1/2011 | Murgida | |
| 2011/0088269 | A1 * | 4/2011 | Walker, Jr. | B26B 21/225 30/527 |
| 2011/0138637 | A1 * | 6/2011 | Bucco | B26B 21/521 30/527 |
| 2013/0061481 | A1 * | 3/2013 | Cooney | B26B 21/521 30/526 |
| 2015/0190935 | A1 * | 7/2015 | Griffin | B26B 21/225 132/200 |
| 2015/0290819 | A1 * | 10/2015 | Giannopoulos | B26B 21/222 30/532 |
| 2015/0306777 | A1 * | 10/2015 | Georgakis | B26B 21/222 30/57 |
| 2015/0314465 | A1 * | 11/2015 | Giannopoulos | B26B 21/222 30/532 |
| 2015/0314466 | A1 * | 11/2015 | Papadopoulos-Papageorgis | B26B 21/222 30/532 |
| 2015/0321366 | A1 * | 11/2015 | Papadopoulos-Papageorgis | B26B 21/222 30/532 |

FOREIGN PATENT DOCUMENTS

| | | | |
|---|---|---|---|
| GB | 2 360 479 A | * | 9/2001 |
| GB | 2471676 A | | 1/2011 |

* cited by examiner

SHAVER

This application is a national stage application of International Application No. PCT/EP2012/076808, filed on Dec. 21, 2012, the entire contents of which are incorporated herein by reference.

The embodiment of the present invention relate to a shaver with interchangeable cartridges, and to cartridges and head and handle assembly for such a shaver.

More particularly, the invention relates to a shaver that includes:

a handle with an elongated body terminating in a mounting portion for retaining a shaver head, a shaver head adapted to accommodate an interchangeable shaving cartridge, a lock-and-release mechanism to enable the interchangeable shaving cartridge to be loaded and ejected from the shaver head, and an interchangeable cartridge containing one or more blades.

Such a shaver enables the user to replace the cartridge once the blade or blades become worn, while the handle and the shaver head can be kept and reused.

BACKGROUND OF THE INVENTION

The removal from the shaver head of the interchangeable blade cartridges, such as those disclosed in e.g. EP2195145, usually requires the user to press or pull the cartridge to actually displace the cartridge. This means that to replace the cartridge, the user needs to encounter the cartridge by his/her fingers. Therefore the risk of the injury of the user is increased.

SUMMARY OF THE INVENTION

A shaver is provided, the shaver that includes a handle with an elongated handgrip portion and a mounting portion, a shaver head, the shaver head being attached to the mounting portion, the shaver head having a back structure, a removable cartridge, the cartridge that includes at least one blade, the cartridge being adapted to be attached to the shaver head and removed from the shaver head, and a button, the button being provided on the shaver head, the button being slidable, the button being adapted to attach and disengage the cartridge to/from the shaver head.

In some embodiments, one may also use one or more of the following features:

the shaver head may be attached pivotally to the mounting portion, the button comprises a holding portion, the holding portion is adapted to attach the cartridge to the shaver head, the button further comprises a body, the cartridge further comprises a holder, wherein the holding portion is a pin, protruding from the body, and wherein the holding portion cooperates with the holder to attach the cartridge to the shaver head, the button is slidable in a direction parallel with the shaving plane, the button comprises a finger receiving region, lateral walls, a bottom part, a body, and a holding portion, wherein the finger receiving region, the lateral walls, and the bottom part form a frame, and wherein the body is provided on the bottom part, protruding towards the finger receiving region, the button defines a neutral position, and wherein the shaver head further comprises a return spring, the return spring being adapted to return the button to the neutral position, the button is adapted to eject the cartridge in a direction perpendicular to the direction of shaving when disengaging the cartridge, the shaver head further comprises at least one leaf spring, adapted to eject the cartridge from the shaver head, the shaver head comprises lateral walls, and the shaver head further comprises a pair of leaf springs, the leaf springs being provided adjacent the lateral walls, the cartridge further comprises a holder, and the holding portion of the button encounters the holder of the cartridge, thus attaching the cartridge to the shaver head, the holding portion of the button is a pin, protruding from the body, and wherein, upon insertion of the cartridge, the pin enters the loop forming the holder and thus retains the cartridge in the shaver head.

In another aspect of the present invention, a cartridge is provided, the cartridge comprises at least one holder, wherein the holder is provided as a closed loop protruding from the cartridge in a direction away from the shaving plane.

In some embodiments, one may also use one or more of the following features:

the cartridge further comprises a top wall and a shaving aid, the shaving aid being provided in the top wall, the cartridge comprises at least one blade, and wherein the at least one blade is mounted movably.

In yet another aspect of the present invention, a head and handle assembly for a shaver is provided, the head and handle assembly that includes a handle with an elongated handgrip portion and a mounting portion, a shaver head, the shaver head being attached to the mounting portion, the shaver head being adapter to receive a cartridge, the shaver head having a back structure, and a button, the button being provided on the shaver head, the button being slidable, the button being adapted to attach and disengage the cartridge to/from the shaver head.

In some embodiments, one may also use one or more of the following features:

the shaver head may be attached pivotally to the shaver head, the button comprises a body and a holding portion, and wherein the holding portion is a pin, protruding from the body, the button is slidable in a direction parallel with the shaving plane, the shaver head further comprises at least one leaf spring, adapted to eject the cartridge from the shaver head.

With these features, the structure of the shaver head and the cartridge is simplified and thus the manufacturing costs are reduced. Moreover, as only the cartridge is replaced when the blades become worn, instead of replacing the whole shaver head, the costs of such shaver are kept lower, while the resiliency and lifetime of the shaver head and the handle are increased. Further, as only the cartridge is replaced, the shaver is both easier to manufacture and more environment friendly, as the amount of material to be replaced (and disposed of) is reduced.

BRIEF DESCRIPTION OF THE DRAWINGS

Other characteristics and advantages of the invention will readily appear from the following description of one of its embodiments, provided as a non-limitative examples, and of the accompanying drawings.

On the drawings.

On the different Figures, the same reference signs designate like or similar elements.

DETAILED DESCRIPTION

Figure 1A:
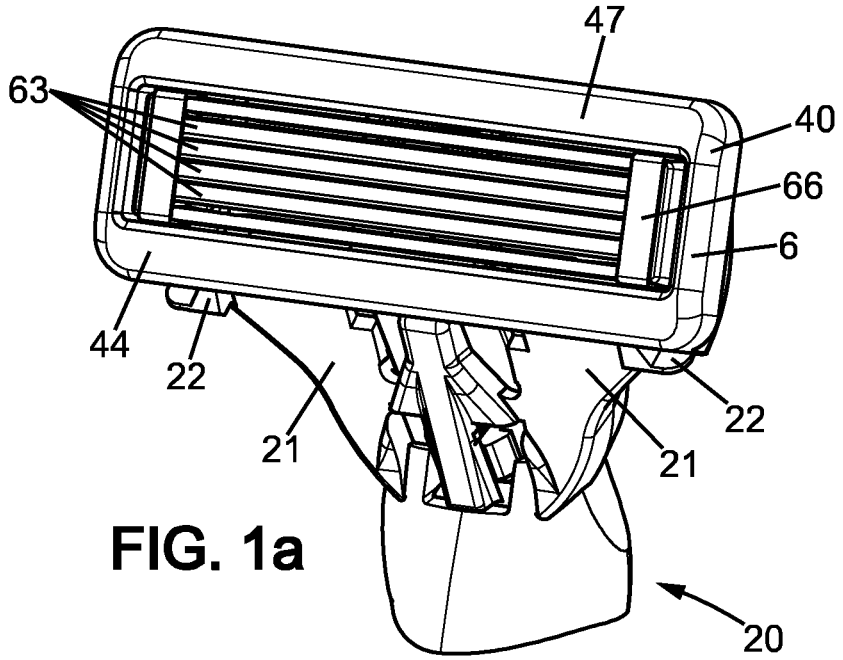
FIG. 1*a* shows an overall view of the shaver from the front side
Figure 1B:
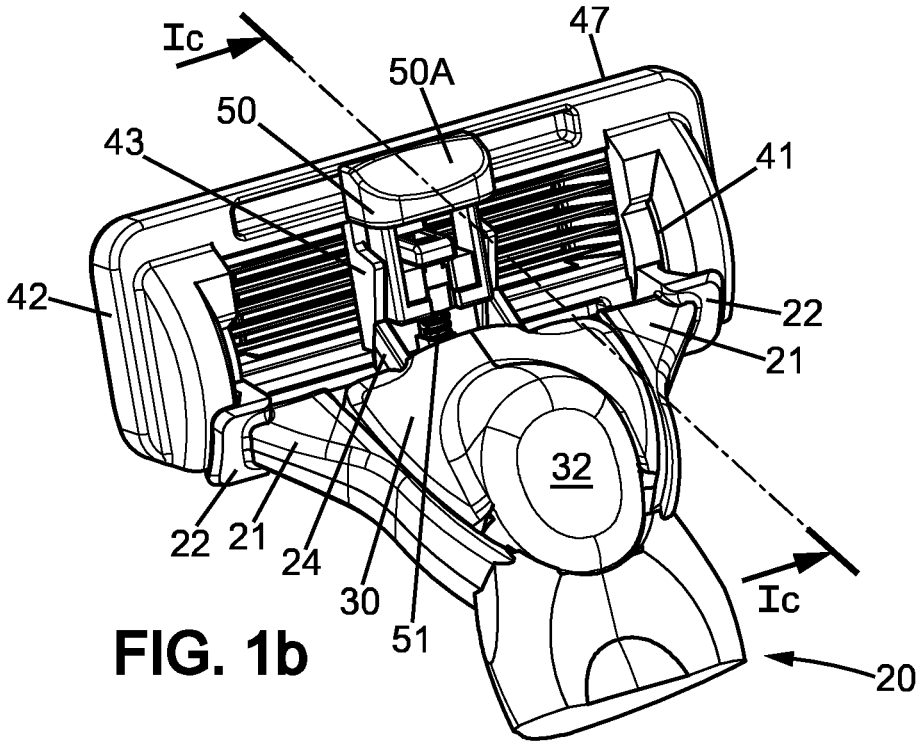
FIG. 1*b* shows an overall view of the shaver from the back side
Figure 1C:
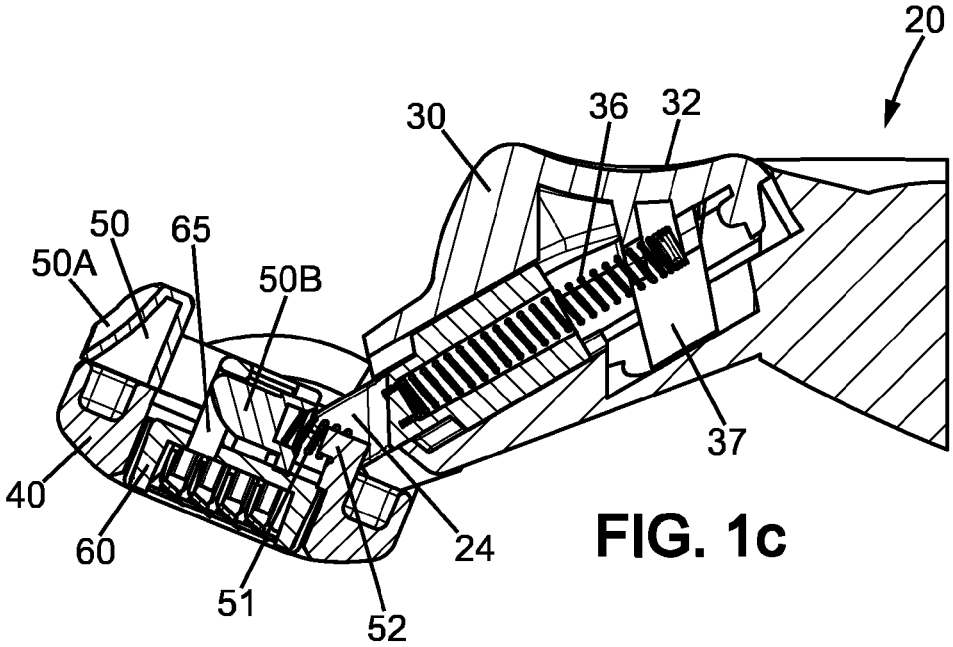
FIG. 1*c* shows a cross-section of the shaver along line Ic

FIGS. 1*a* to 1*c* show an example of a shaver according to the present invention. The shaver comprises a handle 20, a shaver head 40 and a cartridge 60, which accommodates one or more blades 63. On the example shown on the Figures, there are four blades 63 in the cartridge 60. However, the cartridge may also use more or less blades.

Figure 3A:
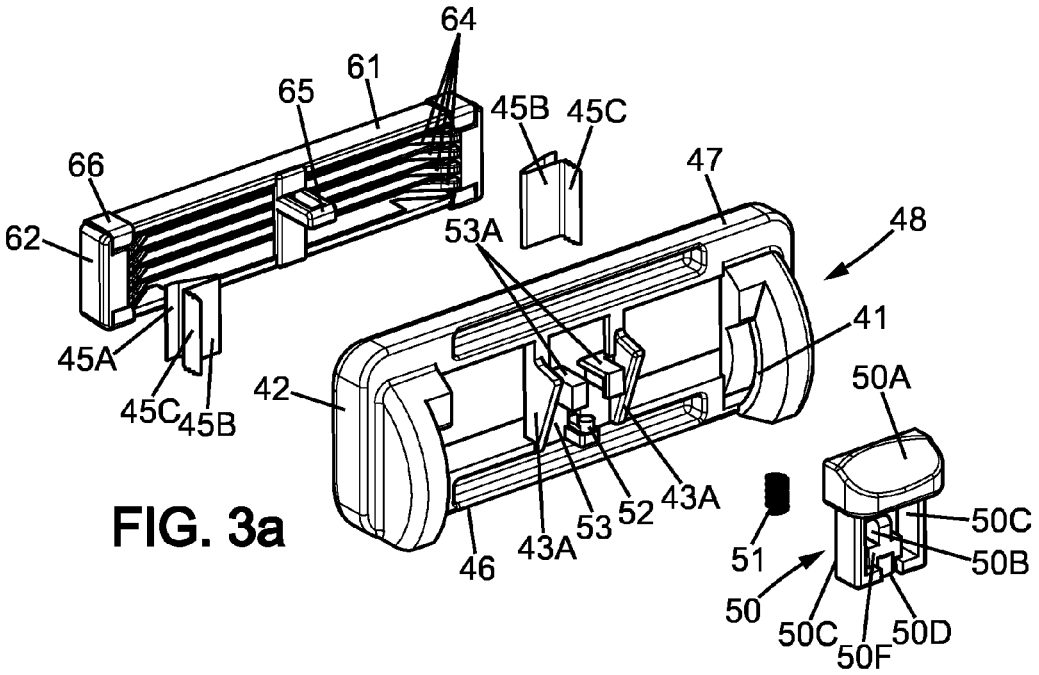
FIG. 3*a* shows an exploded view of a shaver head with a cartridge
Figure 3B:
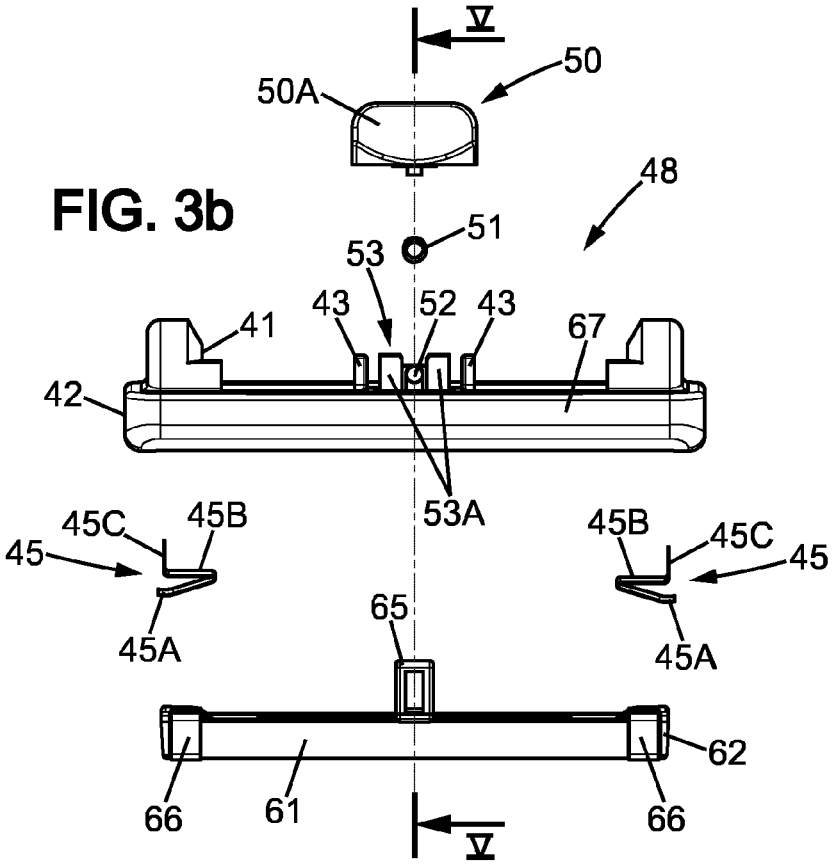
FIG. 3*b* shows an exploded view of a shaver head with a cartridge
Figure 3C:
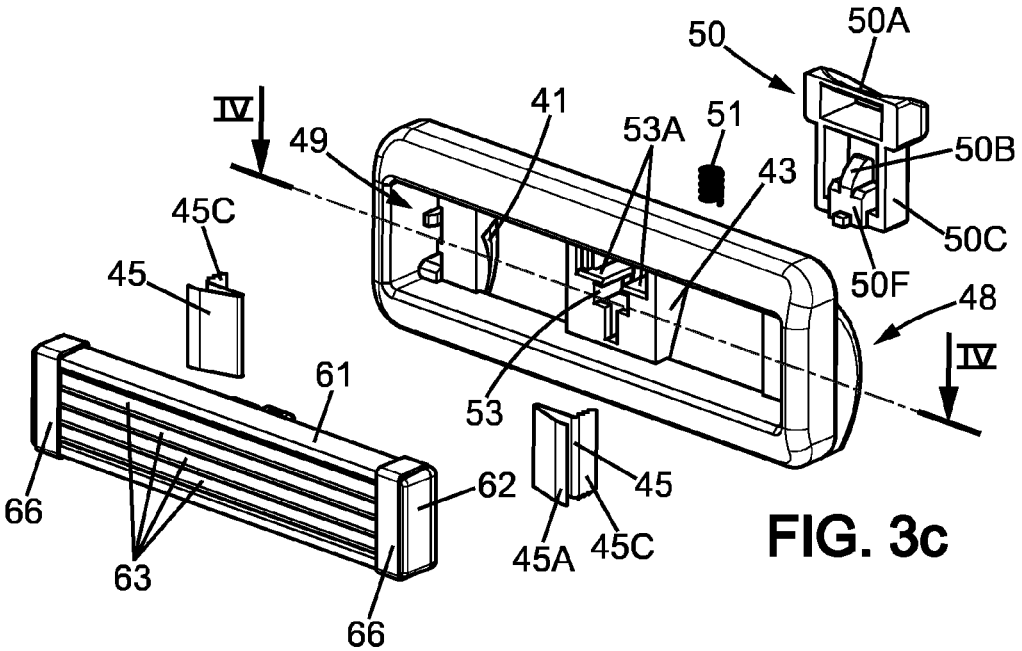
FIG. 3*c* shows an exploded view of a shaver head with a cartridge
Figure 4:
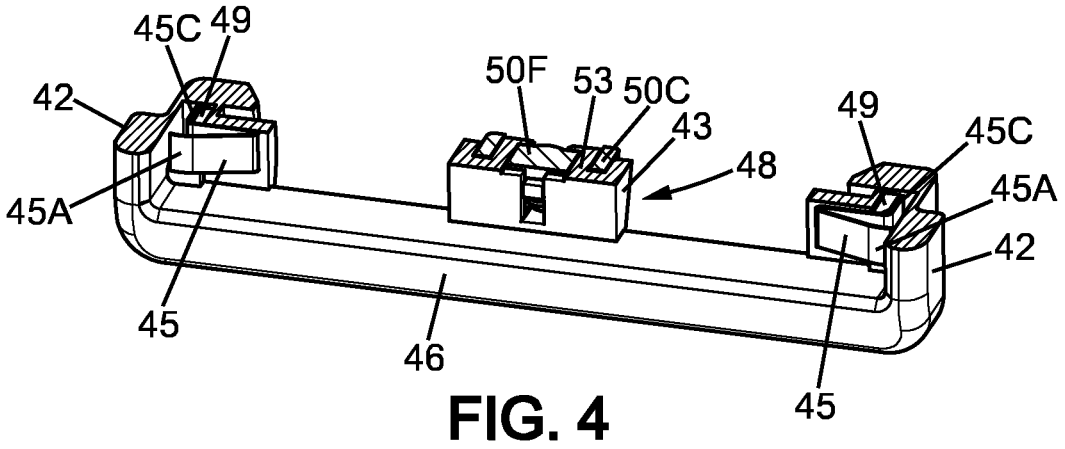
FIG. 4 shows a cross-section of the shaver head without the cartridge along line IV
Figure 5:
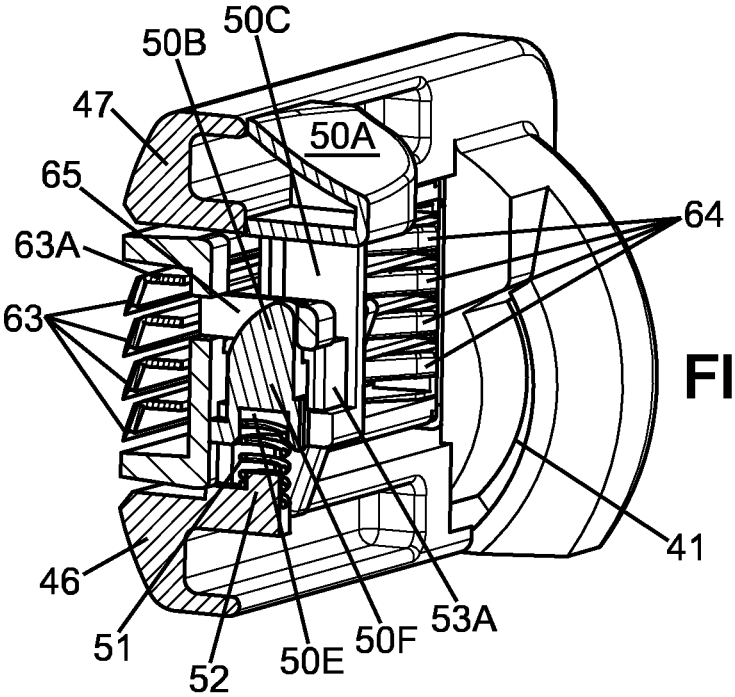
FIG. 5 shows a cross-section of the shaver head with the cartridge along line V
Figure 6A:
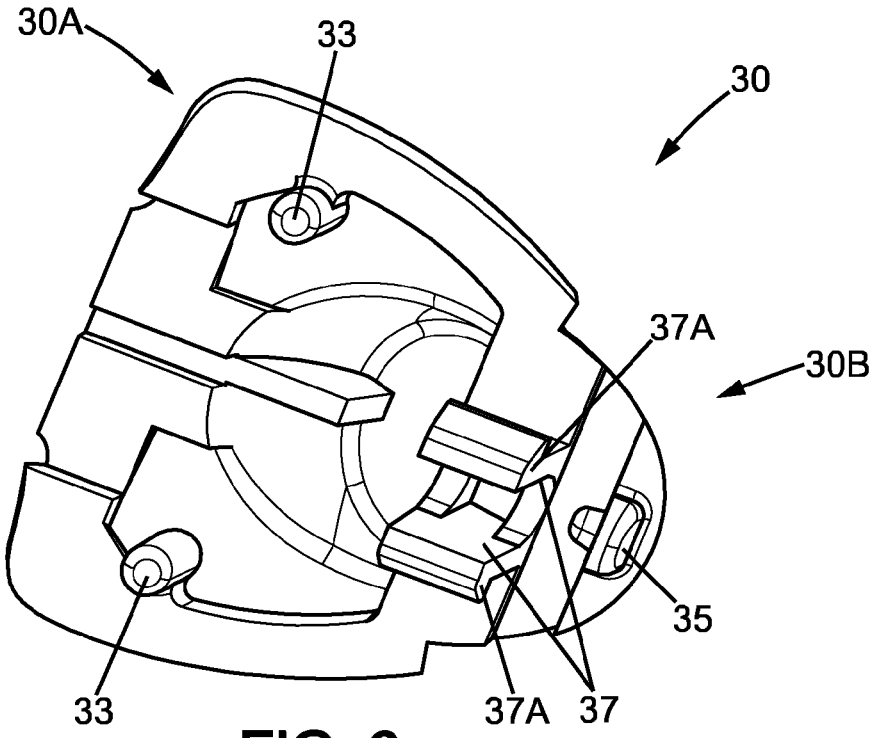
FIG. 6*a* shows a bottom side of the button
Figure 6B:
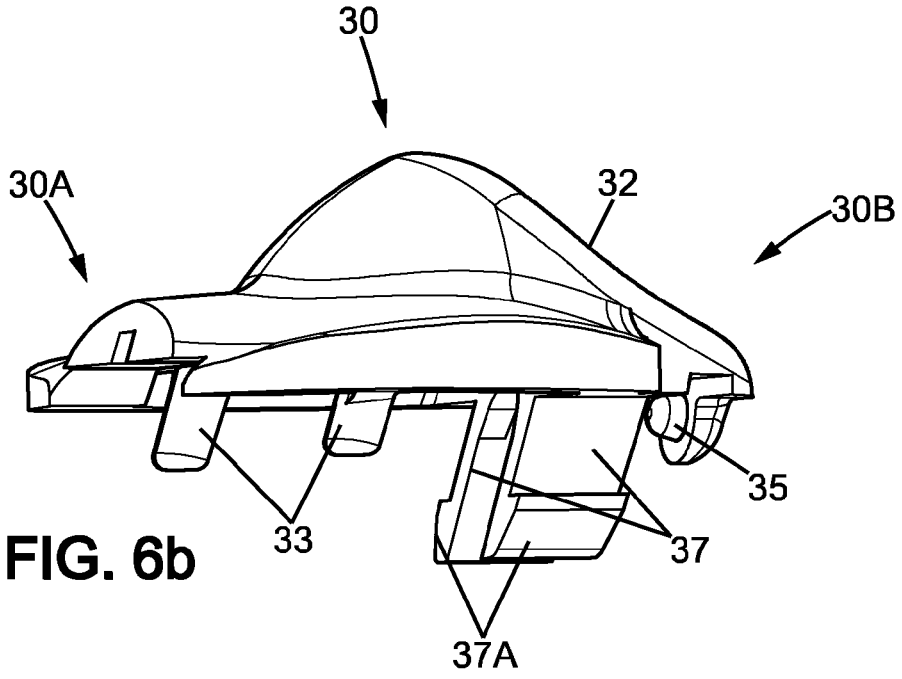
FIG. 6*b* shows an overall view of the button.

The cartridge (ass seen on FIGS. 3*a* to 3*c*) 60 is formed as a frame with a top wall 61, two lateral walls 62, bottom wall 67 and a back structure (shown in detail on FIG. 3*a*). The top wall 61 and the bottom wall 67 are elongated and connected by the lateral walls 62. The frame of the cartridge 60 may be molded out of plastic; preferably, the frame is one-piece. The top wall 61 may further comprise a shaving aid (not shown). The blades 63 extend between the lateral walls 62, parallel to the top wall 61 and the bottom wall 67. The blades 63 may be made from bent sheet metal, or, preferably, they may be straight and supported with blade supports 63A. The blades 63 and/or the blade supports 63A are then accommodated in seats provided in the lateral walls 62. Moreover, the blades may for instance be placed movably. The lateral walls 62 may be provided with elastic fingers 64, extending towards the insides of the cartridge frame, in a direction parallel to the blades 63, and supporting movably the blades 63. The blades 63 may be held in the cartridge 60 by a pair of bent metal strips 66, which encircle the ends of the blades 63 and thus hold them in place. In the top wall 61, lying generally in a plane defined by the blade edges, a shaving aid may be provided. In other embodiments, the blades are fixed.

Figure 2A:
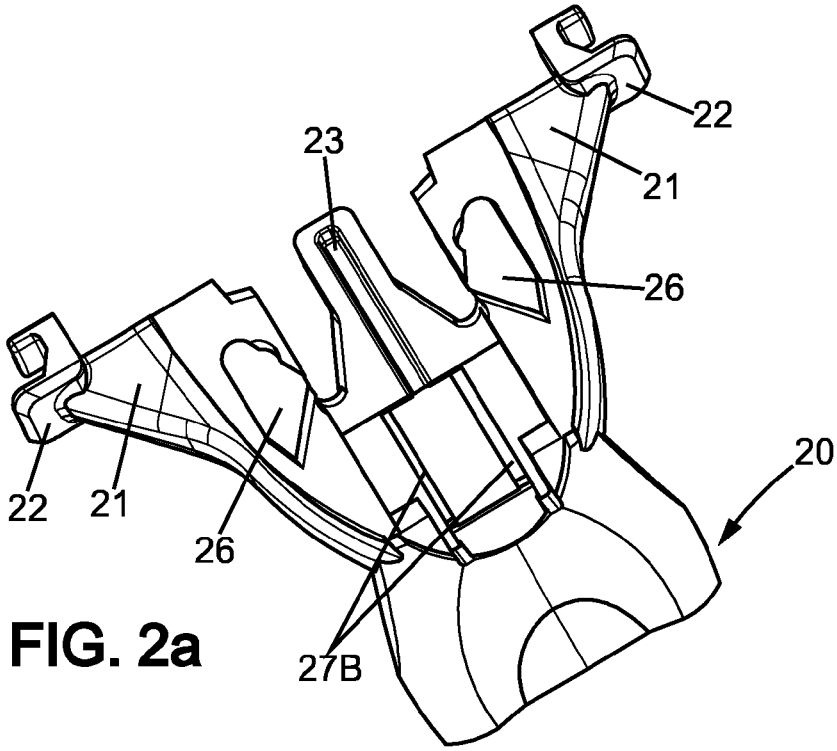
FIG. 2*a* shows a front portion of the handle
Figure 2B:
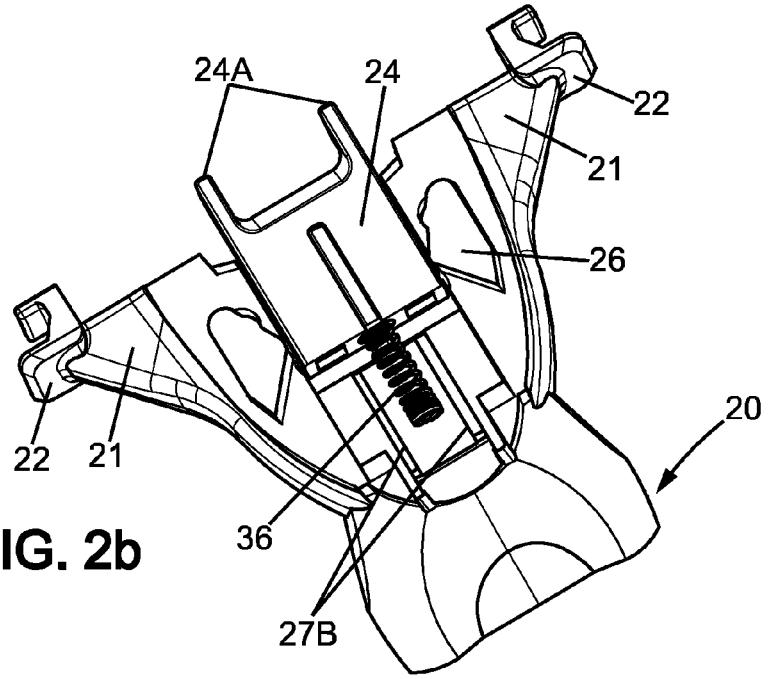
FIG. 2*b* shows a front portion of the handle with a cam follower and a spring

The handle 20 has an elongated handgrip portion (not shown) which may be provided with features that enhance grip of the user and help prevent slipping, such as ribs, pegs, elastomeric parts and the like. The handle 20 is preferably molded out of a plastic material. The handle 20 is terminated in two yokes 21 extending from the handle, as shown on FIGS. 2*a* and 2*b*. The yokes 21 end in a mounting portion, which may be provided in a form of shell bearings 22. The shell bearings then 22 cooperate with complementary depressions 41 provided on the shaver head 40. The shell bearings 22 and the complementary depressions 41 together enable the shaver head 40 to pivot about an axis parallel to the length of the blades 63. Alternatively, the shell bearings 22 may be replaced by hinges, pins or other pivoting means; the shaver head 40 may also be attached to the handle 20 without any pivoting means. Here, only the pivoting head will be described.

The yokes 21 further define a gap 23, positioned between the yokes 21. The gap 23 accommodates a cam follower 24. The cam follower cooperates with rests 43, provided as a part of the back structure 48 of the shaver head 40, therefore enabling the shaver head 40 to be returned to the neutral position when the shaver head 40 is pivoted. The cam follower 24 is operated by a coil spring 36, which is preferably made of metal. The cam follower preferably has a bifurcated end, thus forming two projections 24A. In this way, the cam follower 24 does not interfere with other features provided on the shaver head 40.

An example of a shaver head 40 is shown on FIGS. 3*a* to 3*c* and 4. The shaver head comprises a top wall 47, a back structure 48, a bottom wall 46 and pair of lateral walls 42. The bottom wall 46 may include a skin engaging element or a guard 44, preferably made in an elastomeric material. The guard 44 is provided as lying generally in a shaving plane when the cartridge is inserted. The back structure 48 comprises depressions 41, which accommodate shell bearings 22, positioned at the end of the handle 20. On the back structure 48, there is also a pair of rests 43, the rests 43 cooperating with the projections 24A of the cam follower 24 to return the shaver head 40 to the neutral position. The back structure 48 further comprises a button 50. The button 50 is adapted to attach and disengage the cartridge 60 to and from the shaver head 40.

The button 50 comprises a finger receiving region 50A, lateral walls 50C, and a bottom part 50D, forming together a substantially rectangular frame. The button 50 further comprises a body 50F protruding from the bottom part 50D and being positioned inside the frame, and a holding portion 50B. The holding portion may take a shape of a pin 50B, protruding from the body 50F towards the finger receiving region 50A. The finger receiving region 50A is adapted to be pressed by the user's finger. The finger receiving region 50A may use features which prevent slipping of user's finger, such as pegs, elastomeric parts and the like. The button 50 is positioned in the shaver head 40 such that the finger receiving region 50A is adjacent the top wall 47 of the shaver head 40, the lateral walls 50C are parallel with the lateral walls 42 of the shaver head 40, and the bottom part 50D is positioned adjacent the bottom wall 46 of the shaver head 40.

In the bottom wall 46 of the shaver head 40, a spring holder 52 is provided. The spring holder 52 holds a spring 51. The spring holder 52 preferably takes a shape of small peg protruding from the bottom wall 46 of the shaver head 40 towards the top wall 47. The bottom part 50D of the button 50 is positioned adjacent the spring holder 52.

As can be seen on FIGS. 3*a* to 3*c*, 4 and 5, the button 50 is attached to the shaver head 40 by a button holder 53. The button holder 53 embraces the body 50F of the button 50 and thus prevents the button 50 from disengaging from the shaver head 40. In particular, the button holder 53 has a flat upper portion 53A, which overlaps the body 50F of the button 50 and attaches the button 50 to the shaver head 40. The button 50 is held by the button holder 53 to be slidable. The lateral walls 50C are positioned between the button holder 53 and the rests 43. When the finger receiving region 50A of the button 50 is pressed downwards (in a direction towards the bottom wall 47 of the shaver head 40), the lateral walls 50C work as tracks, thus facilitating sliding of the button 50.

In the bottom part 50D of the button 50, there is a cavity 50E. The cavity accommodates a return spring. The return spring 51 may be provided for example as a leaf spring. In the embodiment shown on the Figures, the return spring 51 is provided as a coil spring 51. The coil spring 51 is provided on the spring holder 52, which supports the spring 51 and may help to prevent the distortion of the coil spring 51. The coil spring 51 provides a return force, which urges the button 50 to be returned to its initial position, when the user disengages his finger from the finger receiving region 50A of the button 50. When the button 50 is pressed by the user, the coil spring 51 is compressed. When the button 50 is released by the user, the coil spring 51 returns the button 50 in a direction towards the top wall 47 of the shaver head 40. The movement of the button 50 upwards is stopped by the upper portion 53A of the button holder 53. Thus the button is prevented from accidental disengaging.

The shaver head 40 forms a seating where the cartridge 60 can be accommodated. The cartridge 60 is preferably inserted from the front, i.e. from a direction perpendicular to the direction of shaving.

Once the cartridge 60 is inserted into the shaver head 40, it encounters the pin 50B provided on the button 50. In an embodiment shown on FIGS. 3*a* to 3*c*, the back structure of the cartridge 60 is provided with a holder 65, which can be encountered by the pin 50B provided on the button 50. The holder 65 provided on the cartridge 60 takes a shape of a planar closed loop, protruding from the back structure of the cartridge 60 generally in a direction away from the shaving plane. The loop defines a plane; preferably, this plane defined by the loop is perpendicular to the direction of shaving. In this embodiment, when the holder 65 is encountered by the pin 50B, the pin 50B enters the loop forming the holder 65 and thus retains the cartridge 60 in the shaver head 40.

Once the cartridge 60 is inserted into the shaver head 40, the cartridge 60 preferably does not perform any movements with respect to the shaver head 40. The shaver head 40 is attached pivotally to the handle 20; preferably, the pivoting means 22, 41 are provided on the shaver head 40 and on the handle 20, but not on the cartridge 60.

When the user wishes to replace the cartridge 60, s/he pushes the button 50. The button 50 is moved downwards, towards the bottom wall 46 of the shaver head 40, and the cartridge 60 is disengaged. More specifically, the pin 50B is disengaged from the loop forming the holder 65 and the cartridge 60 is no more retained in the shaver head 40.

Once the holder 65 is disengaged from the pin 50B, the cartridge 60 may be ejected. To this aim, at least one leaf spring 45 may be provided in the shaver head 40. Preferably, the shaver head 40 is provided with two leaf springs 45, positioned adjacent the lateral walls 42 of the shaver head 40. When the cartridge 60 is inserted in the shaver head 40, the leaf springs 45 find themselves under a tension. Once the cartridge 60 is disengaged, the leaf springs 45 eject the cartridge 60 from the shaver head 40, in a direction generally perpendicular to the shaving plane.

In an embodiment shown on FIGS. 3*a* to 3*c* and 4, the leaf springs 45 comprise an outer end 45A, a V-shaped body 45B and an elongated portion 45C. At one end of the V-shaped body 45B, an elongated portion 45C is provided. The elongated portion 45C is bent by approximately 90 degrees with respect to the adjacent branch of the V-shaped body 45B. The elongated portion 45C cooperated with a leaf spring seat 49. The leaf spring seat 49 is provided in the shaver head 40, adjacent the lateral walls 42. The leaf spring seat 49 is adapted to hold the elongated portion 45C of the leaf spring 45 either snap-fittingly, or by frictional or adhesive forces. When the leaf spring 45 is inserted into the leaf spring seat 49, one branch of the V-shaped body 45B rests against the back structure 48 of the shaver head 40, while the other protrudes at an angle towards the shaving plane. The vertex of the V-shaped body 45B is oriented towards insides of the shaver head 40. On the end opposing the elongated portion 45C, an outer end 45A is provided. The outer end 45A is bent so as to be parallel with the shaving plane. In this way, when the cartridge is inserted, it is first encountered by the outer end 45A of the leaf spring 45, and the frictional damage of the cartridge 60 is reduced.

The leaf spring 45 is preferably made of metal, but may also be made of any suitable material, such as plastic or material with elastic properties.

The above described mechanism, which uses the holder 65 cooperating with the pin 50B provided on the button 50, brings about several advantages. The only replaced component is the cartridge 60, which in itself does not hold any additional features (such as pivoting means and the like). Therefore the price of the cartridge 60 may be lowered and the manufacturing process thereof may be simplified; as the shaver head 40 and the handle 20 are not replaced, they may be manufactured as being more robust while keeping the price reasonable. Especially, the pivoting means provided to perform the pivoting movements are not replaced with the cartridge and thus may be manufactured more reliable. Moreover, the mechanism which holds the cartridge 60 in the shaver head 40 is both easy to manufacture and easy to operate. The simplified design of the cartridge 60 may be further beneficial with regards to sustainability, as the cartridge 60 may be washed with reduced amount of water.

Moreover, when the leaf spring 45 is provided, the user does not have to touch the cartridge 60 by his/her fingers, when the cartridge is disengaged, and the risk of cutting the user's fingers with the blades 63 is then reduced.

Further, as the button 50 is provided on the shaver head, there are no space and/or volume requirements to include the slidable and/or push button and its mechanism on the handle. The handle may thus be designed being more efficient, more resilient, etc. The volume of the button 50 itself may be also reduced, thus reducing the consumption of material.

The top part of the handle 20 adjacent the shaver head 40 may be provided with a finger rest 30 (see FIGS. 7*a* and 7*b*). The finger rest 30 has a front end 30A and a rear end 30B. To prevent the finger rest 30 from disengaging from the handle, there is a pair of guides 37, cooperating with trails 27B. The guides 37 are provided with a bent lower portions 37A, so as to ensure that they do not disengage from the respective guide trails 27B. In this way, the guides 37, when in cooperation with guide trails 27B, prevents the finger rest 30 from moving elsewhere, and also prevents the finger rest 30 from disengaging from the handle 20.

The finger rest 30 comprises a finger receiving region 32, provided on the top part of the button 30. The finger receiving region 32 may be equipped with features that help to prevent slipping of user's fingers. The finger rest 30 is also provided with a coil rest 35, which is positioned at the rear end 30B of the finger rest 30, adjacent the handle 20. The coil rest 35 cooperates with the coil spring 36. When the shaver head 40 is pivoted, the coil spring 36 returns the shaver head 40 to the neutral position.

Moreover, as can be seen on FIGS. 7*a* and 7*b*, the finger rest 30 comprises a pair of safeguards 33. The safeguards 33 generally take a form of pins protruding downwards from the finger rest 30. The handle is adapted to receive these safeguards 33 in grooves 26, carved in the handle 20. The safeguards 33 prevent the yokes 21 from being accidentally moved closer together. When the yokes 21 cannot be moved closer together, the risk of the yokes 21 accidentally releasing the shaver head 40 as a whole is reduced, thus reducing risk of injury of the user.

The invention claimed is:

1. A shaver comprising:

a handle with an elongated handgrip portion and a mounting portion, a shaver head attached to the mounting portion, the shaver head having a back structure, a removable cartridge, the cartridge including at least one blade, the cartridge being adapted to be attached to the shaver head and removed from the shaver head, and a button provided on the shaver head, the button being slidable, the button being adapted to attach and disengage the cartridge to or from the shaver head.

2. The shaver according to claim 1, wherein the shaver head can be attached pivotally to the mounting portion.

3. The shaver according to claim 1, wherein the button includes a holding portion, and wherein the holding portion is adapted to attach the cartridge to the shaver head.

4. The shaver according to claim 3, wherein the button further includes a body, the cartridge further includes a holder, wherein the holding portion is a pin, protruding from the body, and wherein the holding portion cooperates with the holder to attach the cartridge to the shaver head.

5. The shaver according to claim 4, wherein the holding portion of the button is a pin, protruding from the body, and wherein, upon insertion of the cartridge, the pin enters a loop forming the holder and thus retains the cartridge in the shaver head.

6. The shaver according to claim 3, wherein the cartridge further includes a holder, and wherein the holding portion of the button encounters the holder of the cartridge, thus attaching the cartridge to the shaver head.

7. The shaver according to claim 1, wherein the button is slidable in a direction parallel with a direction of shaving.

8. The shaver according to claim 1, wherein the button includes a finger receiving region, lateral walls, a bottom part, a body, and a holding portion, wherein the finger receiving region, the lateral walls, and the bottom part form a frame, and wherein the body is provided on the bottom part, protruding towards the finger receiving region.

9. The shaver according to claim 1, wherein the button defines a neutral position, and wherein the shaver head further includes a return spring, the return spring being adapted to return the button to the neutral position.

10. The shaver according to claim 1, wherein the button is adapted to eject the cartridge in a direction perpendicular to a direction of shaving when disengaging said cartridge.

11. The shaver according to claim 1, wherein the shaver head further includes at least one leaf spring, adapted to eject the cartridge from the shaver head.

12. The shaver according to claim 1, wherein the shaver head includes lateral walls, and wherein the shaver head further includes a pair of leaf springs adapted to eject the cartridge from the shaver head, each of the pair of leaf springs being provided adjacent the lateral walls.

13. A head and handle assembly for a shaver, the head and handle assembly comprising:

a handle with an elongated handgrip portion and a mounting portion, a shaver head, the shaver head being attached to the mounting portion, the shaver head being adapted to receive a cartridge, the shaver head having a back structure, and a button, the button being provided on the shaver head, the button being slidable, the button being adapted to attach and disengage the cartridge to/from the shaver head.

14. The head and handle assembly according to claim 13, wherein the shaver head can be attached pivotally to the mounting portion.

15. The head and handle assembly according to claim 14, wherein the shaver head further includes at least one leaf spring, adapted to eject the cartridge from the shaver head.

16. The head and handle assembly according to claim 13, wherein the button includes a body and a holding portion, and wherein the holding portion is a pin, protruding from the body.

17. The head and handle assembly according to claim 13, wherein the button is slidable in a direction parallel with a direction of shaving.

* * * * *